US011369200B2

(12) United States Patent
Sun

(10) Patent No.: US 11,369,200 B2
(45) Date of Patent: Jun. 28, 2022

(54) FOLDABLE CLOTH-EMBEDDED BLEACHER SEAT

(71) Applicant: Benlong Sun, Jinhua (CN)

(72) Inventor: Benlong Sun, Jinhua (CN)

(73) Assignee: ZHEJIANG PRIDE LEISURE PRODUCTS CO., LTD., Zhejiang (CN)

( * ) Notice: Subject to any disclaimer, the term of this patent is extended or adjusted under 35 U.S.C. 154(b) by 0 days.

(21) Appl. No.: 17/096,963

(22) Filed: Nov. 13, 2020

(65) Prior Publication Data

US 2021/0298479 A1 Sep. 30, 2021

(51) Int. Cl.

| | |
|---|---|
| ***A47C 1/16*** | (2006.01) |
| ***A47C 4/30*** | (2006.01) |
| ***A47C 5/10*** | (2006.01) |
| ***A47C 4/02*** | (2006.01) |
| ***A47C 7/40*** | (2006.01) |
| ***A47C 7/54*** | (2006.01) |

(52) U.S. Cl.

CPC ..... *A47C 1/16* (2013.01); *A47C 4/028* (2013.01); *A47C 4/30* (2013.01); *A47C 5/10* (2013.01); *A47C 7/407* (2013.01); *A47C 7/543* (2013.01)

(58) Field of Classification Search

CPC ..... A47C 1/16; A47C 7/407; A47C 7/543; A47C 5/10; A47C 4/028; A47C 4/30

USPC ..... 297/16.1, 35, 252, 227, 352, 256.16

See application file for complete search history.

(56) References Cited

U.S. PATENT DOCUMENTS

| | | | | | |
|---|---|---|---|---|---|
| D121,266 | S | * | 7/1940 | Archer | D6/368 |
| 2,449,523 | A | * | 9/1948 | Wilson | A47C 1/16 297/252 |
| 2,518,057 | A | * | 8/1950 | Orth | A47C 1/16 297/352 |
| 2,542,820 | A | * | 2/1951 | Legois | A47C 1/16 297/351 |
| 2,699,816 | A | * | 1/1955 | Gittings | A47C 4/30 297/440.11 |
| 2,702,076 | A | * | 2/1955 | Beardsley | A47C 1/16 297/252 |
| 2,725,925 | A | * | 12/1955 | Sanderson | A47C 1/16 297/252 |

(Continued)

FOREIGN PATENT DOCUMENTS

CN 204105347 U * 1/2015

*Primary Examiner* — Robert Canfield

(74) *Attorney, Agent, or Firm* — WPAT Law, P.C.; Anthony King

(57) ABSTRACT

A foldable cloth-embedded bleacher seat has two symmetrical armrest assemblies, a backrest assembly, a cushion assembly and a hook assembly. The backrest assembly has a detachable backrest cloth. The cushion assembly has a detachable cushion cloth cover. A lower part of each of the two sides of the backrest assembly is rotatably connected to the upper side of one armrest assembly, and the bottoms of the two sides of the backrest assembly are rotatably connected to the two sides of the cushion assembly. The lower sides of the two armrest assemblies are rotatably connected to the two sides of the cushion assembly. The hook assembly is detachably installed on the lower surface of the cushion assembly. The bleacher seat is foldable, thereby occupying a small space and being simple, attractive, elegant, firm and durable in overall structure, and convenient and fast to fold and unfold.

16 Claims, 10 Drawing Sheets

(56) References Cited

U.S. PATENT DOCUMENTS

| | | | | |
|---|---|---|---|---|
| 2,957,515 | A * | 10/1960 | Gibson | A47C 4/18 297/252 |
| 6,203,108 | B1 * | 3/2001 | Mattison, Jr. | A47C 1/16 297/252 |
| 6,502,902 | B1 * | 1/2003 | Romero | A47C 1/16 297/352 |
| D814,820 | S * | 4/2018 | Meoli, Jr. | D6/368 |
| 2009/0212614 | A1 * | 8/2009 | Isaac | A47C 4/283 297/252 |
| 2010/0109414 | A1 * | 5/2010 | Chiang | A47C 4/02 297/440.11 |
| 2014/0015287 | A1 * | 1/2014 | Zhu | A47C 4/44 297/35 |
| 2014/0138990 | A1 * | 5/2014 | Chesness | A47C 4/286 297/35 |
| 2019/0231074 | A1 * | 8/2019 | Grace | A47C 4/28 |
| 2019/0335915 | A1 * | 11/2019 | Wang | A47C 31/023 |
| 2020/0405055 | A1 * | 12/2020 | Sun | A47C 7/543 |
| 2021/0307517 | A1 * | 10/2021 | Sun | A47C 4/52 |

* cited by examiner

FOLDABLE CLOTH-EMBEDDED BLEACHER SEAT

BACKGROUND OF THE INVENTION

1. Technical Field

The utility model belongs to the technical field of bleacher seats, and particularly relates to a foldable cloth-embedded bleacher seat.

2. Description of Related Art

Nowadays, the vigorous development of social productivity has greatly improved the creature comfort and spiritual pursuit of people and brought more large-scale sports matches, concerts and evening parties, which in turn promote the emergence of derivatives such as movable bleachers and bleacher seats. Movable bleacher seats in various stadiums and competition areas not only need to be designed to be steady and firm, but also should be attractive, durable, and easy to assemble.

In general, traditional bleacher seats are integrally formed by hard plastic through one-time die casting or are formed by the combination of a non-detachable hard frame and a soft cloth cover, wherein the former ones are easy to clean, but are poor in long-term sitting comfort; and the later ones have better sitting comfort than the former ones, but are difficult to disassemble to be cleaned after being stained, and cannot be assembled conveniently and rapidly. In view of this, the structure of traditional bleacher seats needs to be studied and improved.

BRIEF SUMMARY OF THE INVENTION

The objective of the utility model is to provide a foldable cloth-embedded bleacher seat, which can improve the long-term sitting comfort of users, is convenient to transport, and adopts a cushion and backrest wrapped with recyclable, detachable and washable cloth covers.

To fulfill the aforesaid objective, the following technical solution is adopted by the utility model: a foldable cloth-embedded bleacher seat comprises two symmetrical armrest assemblies, a backrest assembly, a cushion assembly and a hook assembly, wherein the backrest assembly comprises a detachable backrest cloth, the cushion assembly comprises a detachable cushion cloth cover, a lower part of each of the two sides of the backrest assembly is rotatably connected to the upper side of one armrest assembly, the bottoms of the two sides of the backrest assembly are rotatably connected to the two sides of the cushion assembly, the lower sides of the two armrest assemblies are rotatably connected to the two sides of the cushion assembly, and the hook assembly is detachably installed on the lower surface of the cushion assembly.

Furthermore, each armrest assembly comprises two armrest tube plugs, an armrest tube, a U-shaped armrest piece and a support tube, wherein the two armrest tube plugs are respectively arranged at the two ends of the armrest tube, the rear end of the armrest tube is riveted to one side of the backrest assembly, the front end of the armrest tube is riveted to the U-shaped armrest piece a U-shaped concave part of the U-shaped armrest piece is rotatably connected to the upper end of the support tube, and the lower end of the support tube is riveted to one side of the cushion assembly.

Furthermore, each armrest assembly further comprises an armrest connecting iron sheet and a gasket, wherein the lower end of the support tube, the gasket and the armrest connecting iron sheet are riveted in sequence, and the armrest connecting iron sheet is riveted to one side of the cushion assembly.

Furthermore, the backrest assembly further comprises a back tube, two cloth embedding strips and four back tube plugs, wherein the back tube comprises two vertical backrest rods, vertical grooves are formed in front sides of the backrest rods, the four back tube plugs are mounted at openings in the two ends of each of the two backrest rods, and lower parts of the backrest rods are riveted to the armrest tubes; vertical sleeves are arranged on the two sides of the backrest cloth, and the cloth embedding strips penetrate through the vertical sleeves to be embedded in the vertical grooves; and the outer side of each of the two vertical backrest rods is riveted to one armrest tube.

Furthermore, each armrest assembly further comprises a collodion sleeve which sleeves the armrest tube.

Furthermore, the cushion assembly further comprises a seat tube, two cloth embedding strips and two seat tube plugs, wherein the seat tube comprises two straight rods, the front ends of the two straight rods are connected through a cross beam, upper mounting grooves are formed in the upper ends of the straight rods, the cloth embedding strips penetrate through cushion sleeves on the two sides of the cushion cloth cover to be embedded in the upper mounting grooves, and the two seat tube plugs are respectively installed at the front ends of the two straight rods; and the outer sides of the straight rods are respectively riveted to the lower end of the back tube and the lower end of the support tube.

Furthermore, the foldable cloth-embedded bleacher seat further comprises two foot pads which are respectively embedded in lower mounting grooves in the lower ends of the two straight rods.

Furthermore, a thickening layer is arranged below the cushion cloth cover.

Furthermore, the back tube or the seat tube is an integrally-formed U-shaped profile or an integrally-formed H-shaped profile.

Furthermore, the hook assembly comprises a bolt, a soft gasket, an iron hook, an iron hook plastic sheath and a nut, wherein the bolt sequentially penetrates through the cross beam, the soft gasket, the iron hook and the iron hook plastic sheath and is then fixed with the nut, and the iron hook plastic sheath integrally sleeves the iron hook and is able to rotate around the bolt.

Compared with the prior art, the utility model has the following beneficial effects: the bleacher seat is foldable, so that less space is occupied, and batch transport and transfer costs are reduced; and when not used, the bleacher seat can be folded to occupy less aisle space, so that users can walk through bleacher aisles more orderly; the backrest cloth and the cushion cloth cover adopt an embedded design, and thus can be assembled, disassembled and replaced rapidly; and the bleacher seat is simple, attractive, elegant, firm and durable in overall structure and can be folded and unfolded conveniently and rapidly.

In the figures: 1, armrest assembly; 2, backrest assembly; 3, cushion assembly; 4, hook assembly; 5, backrest cloth; 6, back tube plug; 7, collodion sleeve; 8, armrest tube plug; 9, support tube; 10, seat tube plug; 11, cross beam; 12, connecting iron sheet; 13, gasket; 14, cushion-backrest connecting piece; 15, U-shaped armrest piece; 16, back tube; 17, cloth embedding strip; 18, seat tube; 19, foot pad; 20, cushion cloth cover; 21, rivet; 22, armrest tube; 23, iron hook plastic sheath; 24, iron hook; 25, soft gasket; 26, bolt; 27, nut; 28, vertical cylindrical sleeve; 29, vertical groove; 30, thickening layer; 31, cushion sleeve; 32, notch; 33, bent rib; 34, back plate; 35, movable bleacher frame; 36, lower groove; 37, upper groove.

DETAILED DESCRIPTION OF THE INVENTION

The technical solution of the invention is further described and explained below with reference to specific embodiments to be understood more clearly. Those skilled in the art can easily appreciate other advantages and effects of the invention by referring to the contents in the specification. The utility model can also be implemented or applied in other different forms, and various modifications or transformations can be made to the details in the specification on the basis of different viewpoints and different applications without departing from the spirit of the utility model.

Figure 1A:
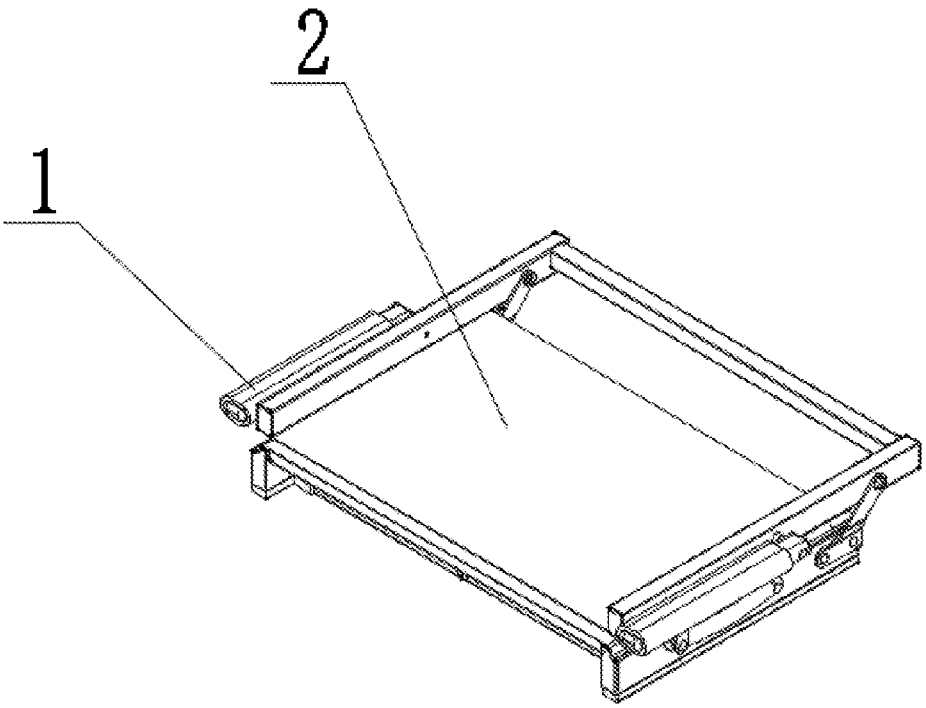
FIG. 1*a* is a folded view of a cloth-embedded bleacher seat.
Figure 1B:
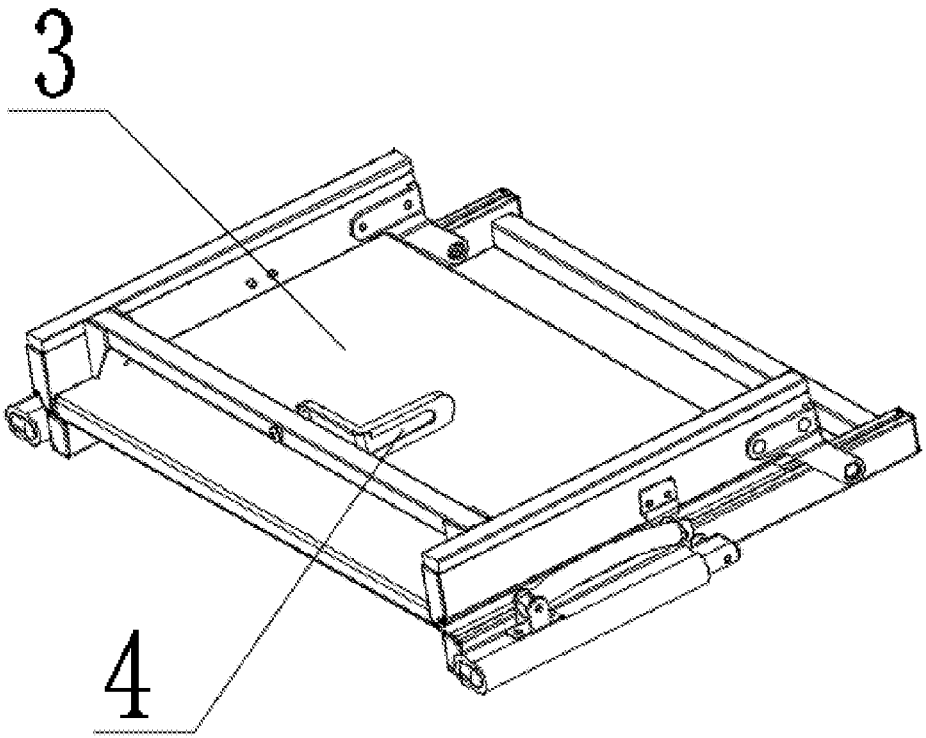
FIG. 1*b* is another folded view of the cloth-embedded bleacher seat in FIG. 1*a;*
Figure 2:
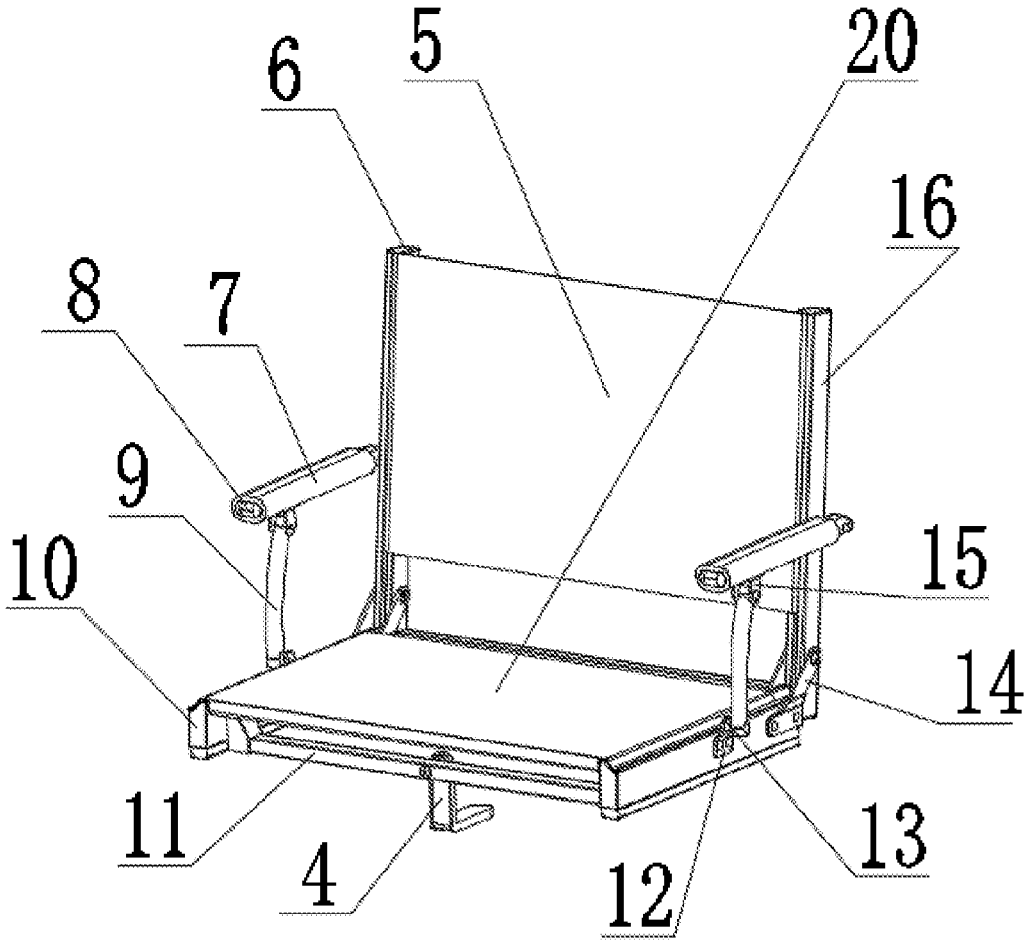
FIG. 2 is an unfolded view of the foldable cloth-embedded bleacher seat.

This embodiment provides a bleacher seat, which is designed to be of an embedded cloth structure and is provided with armrests, a bottom hook and a backrest capable of being folded, thereby being convenient to transport and store. As shown in FIG. 1*a*, FIG. 1*b* and FIG. 2, the bleacher seat primarily consists of two symmetrical armrest assemblies 1, a backrest assembly 2, a cushion assembly 3 and a hook assembly 4. The backrest assembly 2 comprises a detachable backrest cloth 5, the cushion assembly 3 comprises a detachable cushion cloth cover 20, a lower part of each of the two sides of the backrest assembly 2 is rotatably connected to the upper side of one armrest assembly 1, the bottoms of the two sides of the backrest assembly 2 are rotatably connected to the two sides of the cushion assembly 3, the lower sides of the two armrest assemblies 1 are rotatably connected to the two sides of the cushion assembly 3, and the hook assembly 4 is detachably installed on the lower surface of the cushion assembly 3.

Figure 3:
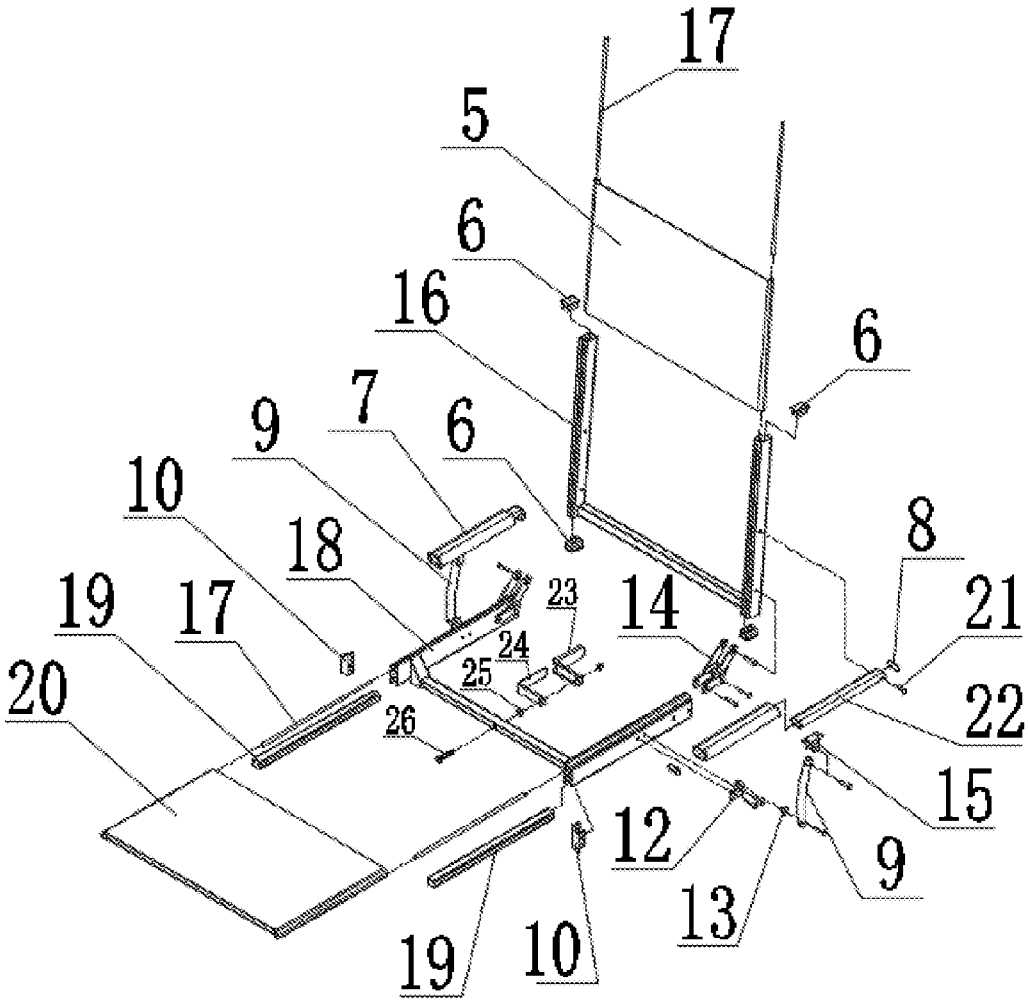
FIG. 3 is an exploded view of the foldable cloth-embedded bleacher seat.
Figure 4:
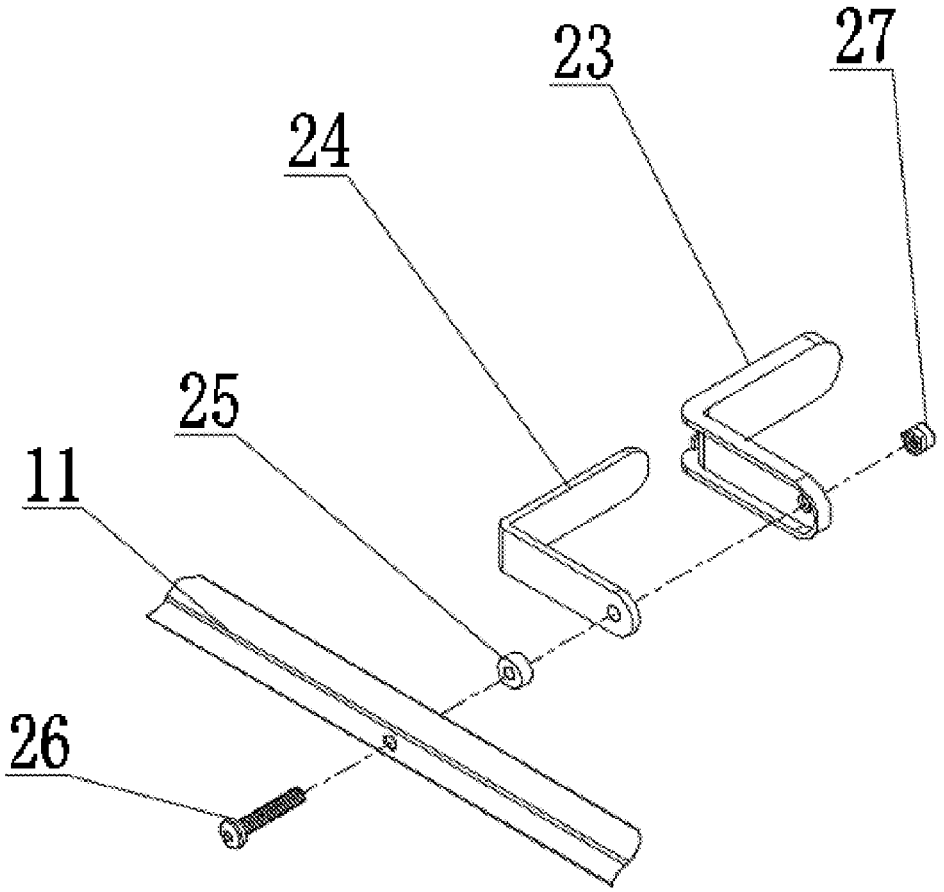
FIG. 4 is an exploded view of a hook assembly.
Figure 5:
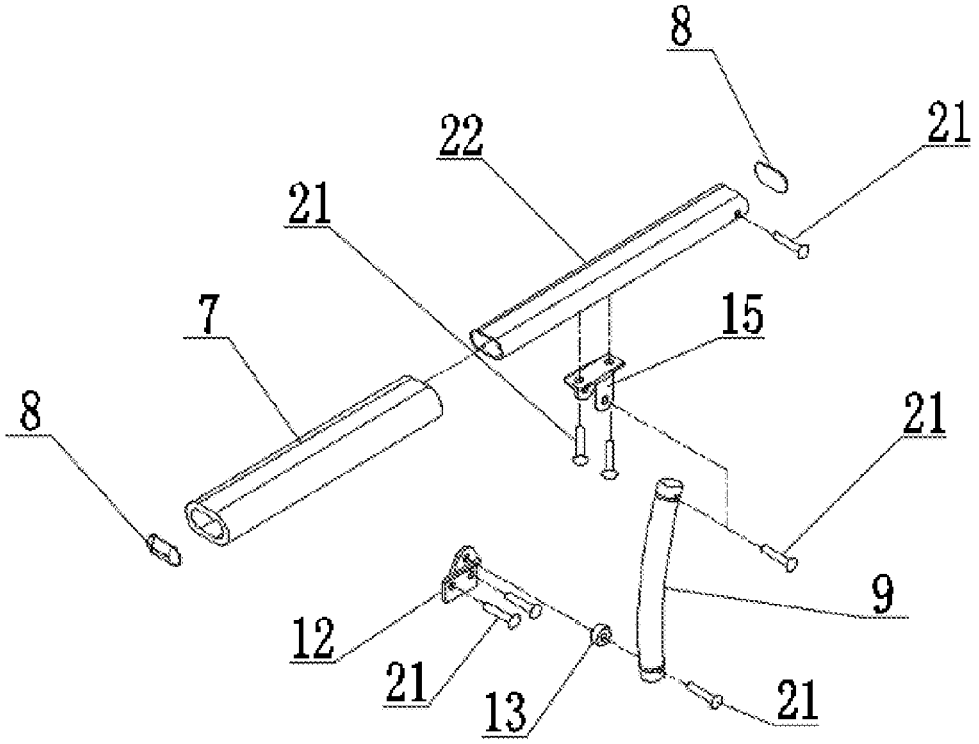
FIG. 5 is an exploded view of an armrest assembly.

Referring to the exploded view (FIG. 3) which shows the assembled parts and assembled structure of the bleacher seat, the hook assembly 4 is located in the middle of a cross beam 11 of a seat tube in the cushion assembly 3 and is located under the cushion cloth cover 20, and the left and right armrest assemblies 1 are connected to the cushion assembly 3 and the backrest assembly 2. Specifically:

Each armrest assembly 1 primarily consists of two tube plugs 8, an armrest tube 22, a collodion sleeve 7, a U-shaped armrest piece 15, a support tube 9, an armrest connecting iron sheet 12, a gasket 13 and seven rivets 21, wherein the two armrest tube plugs 8 are inserted into the two ends of the armrest tube 22 which is sleeved with the collodion sleeve 7, a through hole is formed in the tail of the armrest tube 22, one rivet 21 penetrates through the through hole to be fixedly connected to a back tube 16 of the backrest assembly 2, the bottom of the front end of the armrest tube 22 is fixedly connected to the U-shaped armrest piece 15 through one rivet 21, a U-shaped concave part of the U-shaped armrest piece 15 is rotatably and movably connected to one end of the support tube 9 through one rivet 21, the side, towards a seat tube 18 of the cushion assembly 3, of the other end of the support tube 9 is spaced by the gasket 13 and is rotatably and movably connected to the seat tube 18 through the armrest connecting iron sheet 12, and the armrest connecting iron sheet 12 is fixed to the seat tube 18 through one rivet 21. In a preferred implementation, the support tube 9 is a slightly-bent hollow tubular part, namely an arc tube.

The backrest assembly 2 primarily consists of a back tube 16, two cloth embedding strips 17, a backrest cloth 5 and four back tube plugs 6, wherein the back tube 16 is an integrated U-shaped structure and includes two vertical backrest rods made of profiles, and vertical grooves 29 (matched with the back tube 16) are formed in the sides, towards the back of users, of the backrest rods; the two sides, connected to the back tube 16, of the backrest cloth 5 are designed as vertical sleeves 28 (preferably cylindrical sleeves), the outer circles of the vertical cylindrical sleeves 28 are slightly smaller than the inner circles of the vertical grooves 29, and the long circular cloth embedding strips 17 penetrate through the inner circles of the vertical cylindrical sleeves 29 to be combined with the backrest cloth 5 and then stretch into the inner circles of the vertical grooves 29; a large flat surface of the backrest cloth 5 is located between the two vertical backrest rods of the back tube 16 and is elastically tensioned slightly; and the four back tube plugs 6 are used to seal the open ends of the two backrest rods of the back tube 16.

The cushion assembly 3 primarily consists of a seat tube 18, two foot pads 19, two cloth embedding strips 17, a cushion cloth cover 20 and two seat tube plugs 10, wherein the seat tube 18 is of an integrated U-shaped structure and includes two straight rods, the parts, close to the knees of a user sitting on the bleacher seat (namely the front ends), of the two straight rods are connected through the cross beam 11, the straight rods of the seat tube 18 are made of profiles, upper grooves 37 are formed in the upper surfaces, where the cushion cloth cover 20 is assembled, of the two straight rods, cushion sleeve 31 (preferably cylindrical sleeves) are arranged at the two ends, to be combined with the seat tube 18, of the cushion cloth cover 20, and the cloth embedding strips 17 penetrate through the inner circles of the cushion sleeves 31 to be combined with the cushion cloth cover 20, are then embedded in the upper grooves 37 in the seat tube 18, and are elastically tensioned slightly. In this embodiment, a thickening layer 30 (made of soft materials such as sponge) is arranged in the middle of the cushion cloth cover 20 to improve the sitting comfort of users. Lower grooves 36 are formed in the sides towards the ground (namely the lower surfaces) of the two straight rods of the seat tube 18 and are preferably dovetail grooves which are assembled in cooperation with dovetail convex parts on the upper surfaces of the foot pads 19 made of soft materials (such as rubber or sponge). A small hole is formed in the middle of the cross beam 11 connected to the seat tube 18 and is used for installing a bolt 26. The two seat tube plugs 10 are used to seal openings in the front ends of cross rods on the two sides of the seat tube 18.

Figure 8:
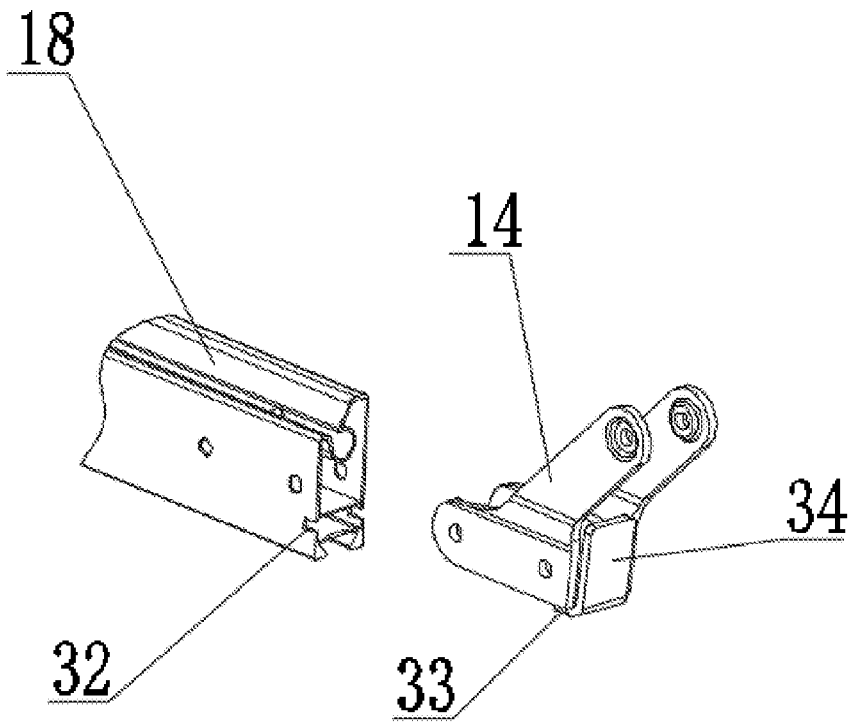
FIG. 8 is a partial assembly diagram of a cushion-backrest connecting piece and a seat tube.

The backrest assembly 2 and the cushion assembly 3 are connected through two cushion-backrest connecting pieces 14 and a plurality of rivets 21. The cushion-backrest connecting pieces 14 are concave bent parts, one end of each cushion-backrest connecting piece 14 is fixed to the seat tube 18 through two rivets 21 (as shown in FIG. 8), and the lower end of the back tube 16 of the backrest assembly 2 is rotatably and movably connected to the other end of each cushion-backrest connecting piece 14. The two edges of a back plate 34 on the cushion-backrest connecting pieces 14 respectively abut against the profile ends of the back tube 16 (backrest rods) and the seat tube 18 (straight rods), and bent ribs 33 on the cushion-back connecting pieces 14 are clamped in notches 32 in the seat tube 18.

The hook assembly 4 is installed on the cross beam 11 of the seat tube and primarily consists of a bolt 26, a soft gasket 25, an iron hook 24, an iron hook plastic sheath 23 and a nut 27, wherein the soft gasket 25 is located on the inner side of the cross beam 11 connected to the seat tube; the bolt 26 penetrates through the iron hook 24 sleeved with the iron hook plastic sheath 23 and the soft gasket 25 and is tightened with the nut 27; and the iron hook plastic sheath 23 integrally sleeves the iron hook 24 and is able to rotate by 180°.

Figure 6:
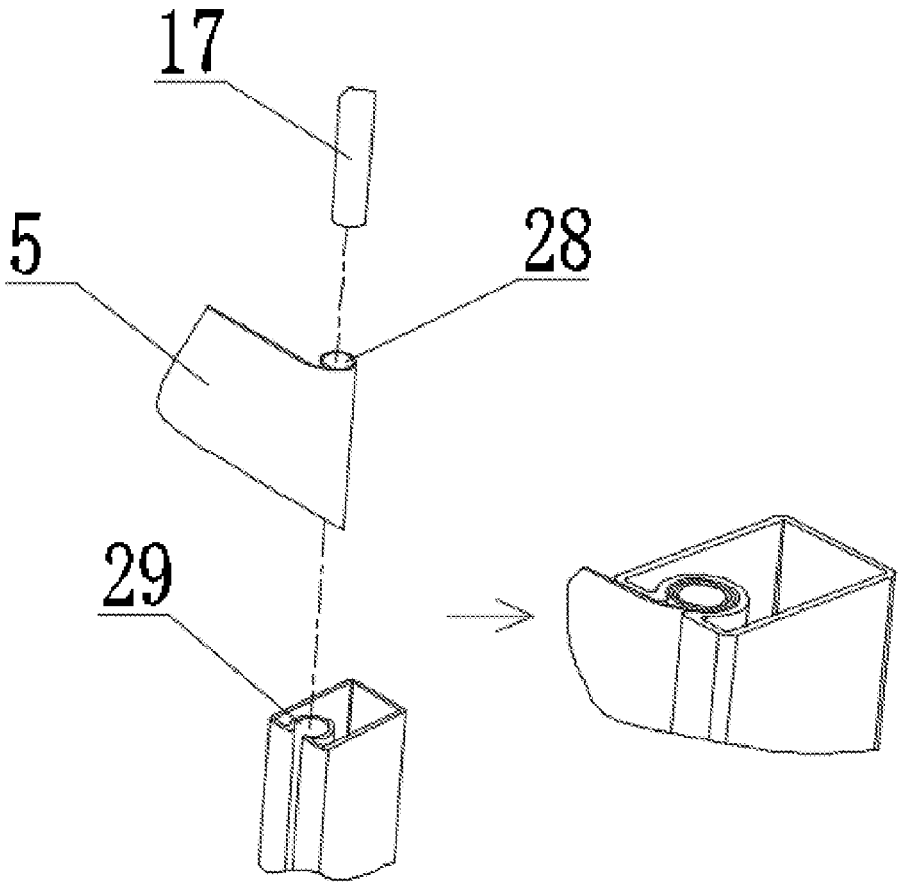
FIG. 6 is a partial assembly diagram of a backrest assembly.
Figure 7:
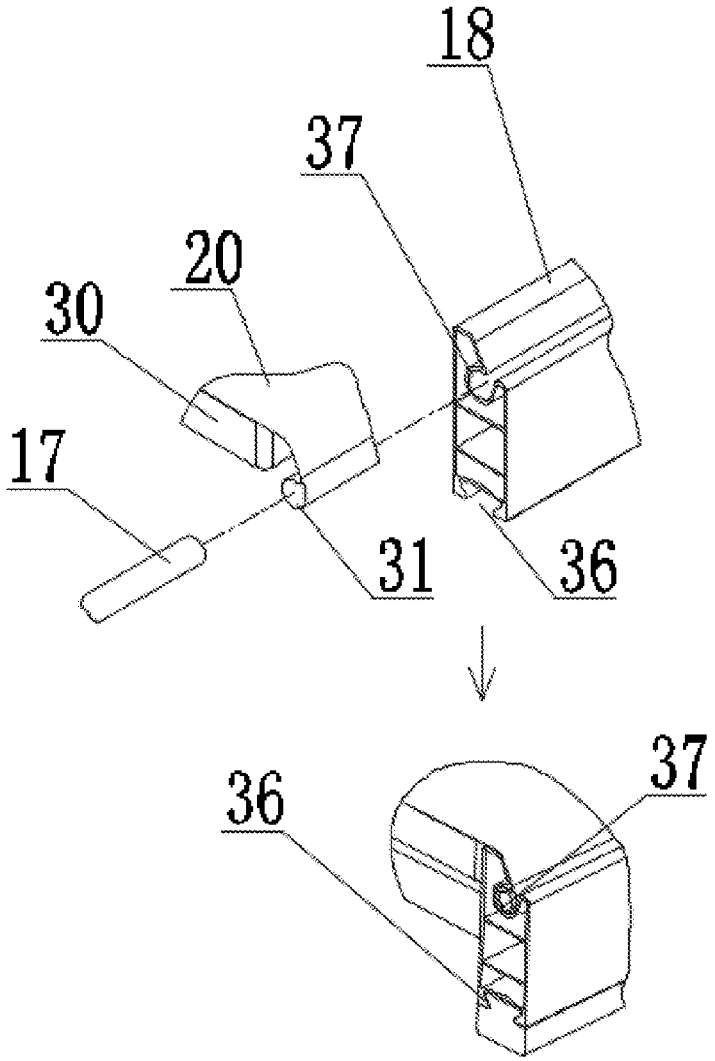
FIG. 7 is a partial assembly diagram of a cushion assembly.

Please refer to FIG. 6 for assembly and disassembly for washing of the backrest cloth 5 of the bleacher seat in this embodiment, and refer to FIG. 7 for assembly and disassembly for washing of the cushion cloth cover 20. The assembly process of the backrest cloth 5 of the bleacher seat is as follows: the back tube 16 is secured, then the cloth embedding strips 17 penetrate through the inner circles of the vertical cylindrical sleeves 28 of the backrest cloth 5 to be combined with the backrest cloth 5 and then stretch into the inner circles of the vertical grooves 29 in the backrest rods of the back tube 16 until the large flat surface of the backrest cloth 5 is located between the two vertical backrest rods of the back tube 16 and is elastically tensioned slightly. Similarly, the assembly process of the cushion cloth cover 20 is as follows: the cloth embedding strips 17 penetrate through the inner circles of the cushion sleeves 31 of the cushion cloth cover 20 to be combined with the cushion cloth cover 20 and then stretch into the inner circles of the upper grooves 37 in the seat tube 18 until the big flat surface of the cushion cloth cover 20 is located between the straight rods on the two sides of the seat tube 18 and is elastically tensioned slightly. The backrest cloth 5 and the cushion cloth cover 20 can be reversely operated to be disassembled and then can be taken out to be washed.

As shown in FIG. 1, the bleacher seat in this embodiment is folded as follows: first, the iron hook 24 and the iron hook plastic sheath 23 of the hook assembly 4 are rotated by 90° to be parallel to the cross beam 11 of the seat tube and be located below the thickening layer 30 of the cushion cloth cover 20; and then, the backrest assembly 2 is rotated towards the cushion assembly 3 around rotation points of the cushion-backrest connecting pieces 14, and the armrest assemblies 1 are synchronously driven to move to be folded. In this way, the hook assembly 4, the cushion assembly 4, the backrest assembly 2 and the armrest assemblies 1 are folded on one plane layer by layer to facilitate storage and transport of the bleacher seat.

As shown in FIG. 2, the bleacher seat in this embodiment is unfolded as follows: at first, the backrest assembly 2 is rotated away from the cushion assembly around the rotation points of the cushion-backrest connecting pieces 14, and the armrest assemblies 1 are driven to move to be unfolded synchronously; and when the lower end of the back tube 16 of the backrest assembly 2 abuts against the back plate 34 on the cushion-backrest connecting pieces 14, the backrest assembly 2 stops rotating; at this moment, the angle between the backrest assembly 2 and the cushion assembly 3 is in the seat condition; and then, the iron hook 24 and the iron hook plastic sheath 23 of the hook assembly 4 are rotated downwards by 90° to be perpendicular to the cross beam 11 of the seat tube, so that the bleacher seat is completely unfolded.

Figure 9:
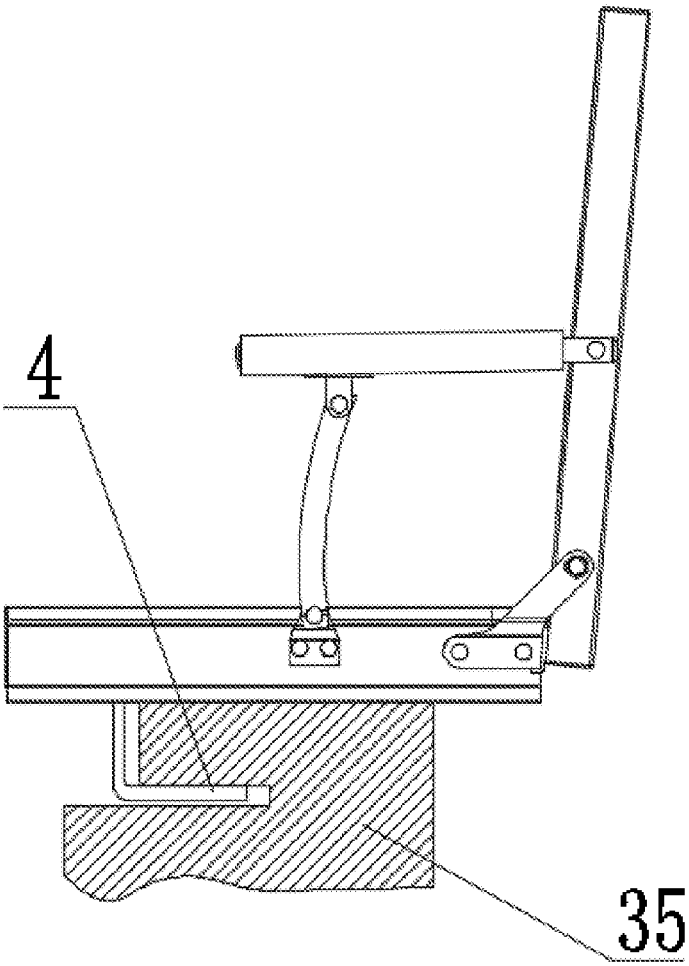
FIG. 9 is a schematic diagram of the foldable cloth-embedded bleacher seat in a working condition.

As illustrated by FIG. 9 which shows the working condition of the bleacher seat in this embodiment, the unfolded bleacher seat can be rapidly installed by stretching the hook assembly 4 into a corresponding hole of a movable bleacher frame 35.

The aforementioned embodiments are only preferred ones of the utility model, and are not intended to limit the protection scope of the utility mode, and all transformations and improvements made by those skilled in the art according to the design concept of the utility model should fall within the protection scope of the utility model. More particularly, various transformations and improvements can be made to the constituent parts and/or the layout of the subject matter within the scope of the drawings and claims of this application. In addition to these transformations and improvements to the constituent parts and/or the layout, other applications will also be obvious to those skilled in the art.

What is claimed is:

1. A foldable cloth-embedded bleacher seat, comprising two symmetrical armrest assemblies, a backrest assembly, a cushion assembly and a hook assembly, wherein the backrest assembly comprises a detachable backrest cloth, the cushion assembly comprises a detachable cushion cloth cover, bottoms of the two sides of the backrest assembly are rotatably connected to two sides of the cushion assembly, lower sides of the two armrest assemblies are rotatably connected to the two sides of the cushion assembly respectively, and the hook assembly is detachably installed on a lower surface of the cushion assembly; and wherein each said armrest assembly comprises two armrest tube plugs, an armrest tube, a U-shaped armrest piece and a support tube, wherein the two armrest tube plugs are respectively arranged at two ends of the armrest tube, a rear end of the armrest tube is riveted to one side of the backrest assembly, a front end of the armrest tube is riveted to the U-shaped armrest piece, a U-shaped concave part of the U-shaped armrest piece is rotatably connected to an upper end of the support tube, and a lower end of the support tube is riveted to one side of the cushion assembly.

2. The foldable cloth-embedded bleacher seat according to claim 1, wherein each said armrest assembly further comprises an armrest connecting iron sheet and a gasket, the lower end of the support tube, the gasket and the armrest connecting iron sheet are riveted in sequence, and the armrest connecting iron sheet is riveted to one side of the cushion assembly.

3. The foldable cloth-embedded bleacher seat according to claim 2, wherein the backrest assembly further comprises a back tube, two cloth embedding strips and four back tube plugs; the back tube comprises two vertical backrest rods, vertical grooves are formed in front sides of the backrest rods, the four back tube plugs are installed at openings in two ends of each of the two backrest rods, and lower parts of the backrest rods are riveted to the armrest tubes; vertical sleeves are arranged on two sides of the backrest cloth, and the cloth embedding strips penetrate through the vertical sleeves to be embedded in the vertical grooves; and an outer side of each of the two vertical backrest rods is riveted to one said armrest tube.

4. The foldable cloth-embedded bleacher seat according to claim 2, wherein a thickening layer is arranged below the cushion cloth cover.

5. The foldable cloth-embedded bleacher seat according to claim 1, wherein the backrest assembly further comprises a back tube, two cloth embedding strips and four back tube plugs; the back tube comprises two vertical backrest rods, vertical grooves are formed in front sides of the backrest rods, the four back tube plugs are installed at openings in two ends of each of the two backrest rods, and lower parts of the backrest rods are riveted to the armrest tubes; vertical sleeves are arranged on two sides of the backrest cloth, and the cloth embedding strips penetrate through the vertical sleeves to be embedded in the vertical grooves; and an outer side of each of the two vertical backrest rods is riveted to one said armrest tube.

6. The foldable cloth-embedded bleacher seat according to claim 5, wherein each said armrest assembly further comprises a sleeve which sleeves the armrest tube.

7. The foldable cloth-embedded bleacher seat according to claim 6, wherein a thickening layer is arranged below the cushion cloth cover.

8. The foldable cloth-embedded bleacher seat according to claim 5, wherein the cushion assembly further comprises a seat tube, two cloth embedding strips and two seat tube plugs; the seat tube comprises two straight rods, front ends of the two straight rods are connected through a cross beam, upper mounting grooves are formed in upper ends of the straight rods, the cloth embedding strips penetrate through cushion sleeves on two sides of the cushion cloth cover to be embedded in the upper mounting grooves, and the two seat tube plugs are respectively installed at the front ends of the two straight rods; and outer sides of the straight rods are respectively riveted to a lower end of the back tube and the lower end of the support tube.

9. The foldable cloth-embedded bleacher seat according to claim 8, further comprising two foot pads which are respectively embedded in lower mounting grooves in lower ends of the two straight rods.

10. The foldable cloth-embedded bleacher seat according to claim 9, wherein the hook assembly comprises a bolt, a gasket, an iron hook, an iron hook plastic sheath (23) and a nut; the bolt sequentially penetrates through the cross beam, the soft gasket, the iron hook and the iron hook plastic sheath, and is then fixed with the nut; and the iron hook plastic sheath integrally sleeves the iron hook and is able to rotate around the bolt.

11. The foldable cloth-embedded bleacher seat according to claim 9, wherein the back tube or the seat tube is an integrally-formed U-shaped profile or an integrally-formed H-shaped profile.

12. The foldable cloth-embedded bleacher seat according to claim 9, wherein a thickening layer is arranged below the cushion cloth cover.

13. The foldable cloth-embedded bleacher seat according to claim 8, wherein the back tube or the seat tube is an integrally-formed U-shaped profile or an integrally-formed H-shaped profile.

14. The foldable cloth-embedded bleacher seat according to claim 8, wherein the hook assembly comprises a bolt, a soft gasket, an iron hook, an iron hook plastic sheath (23) and a nut; the bolt sequentially penetrates through the cross beam, the soft gasket, the iron hook and the iron hook plastic sheath, and is then fixed with the nut; and the iron hook plastic sheath integrally sleeves the iron hook and is able to rotate around the bolt.

15. The foldable cloth-embedded bleacher seat according to claim 8, wherein a thickening layer is arranged below the cushion cloth cover.

16. The foldable cloth-embedded bleacher seat according to claim 1, wherein a thickening layer is arranged below the cushion cloth cover.

* * * * *